US008251778B2

(12) United States Patent
Futamura

(10) Patent No.: US 8,251,778 B2
(45) Date of Patent: Aug. 28, 2012

(54) DOUBLE-SIDE GRINDING APPARATUS FOR WAFER AND DOUBLE-SIDE GRINDING METHOD

(75) Inventor: Hiroyasu Futamura, Omura (JP)

(73) Assignee: Sumco Techxiv Corporation, Omura-Shi (JP)

( * ) Notice: Subject to any disclaimer, the term of this patent is extended or adjusted under 35 U.S.C. 154(b) by 546 days.

(21) Appl. No.: 12/607,265

(22) Filed: Oct. 28, 2009

(65) Prior Publication Data

US 2010/0144248 A1 Jun. 10, 2010

(30) Foreign Application Priority Data

Oct. 31, 2008 (JP) ..... 2008-282257
Oct. 22, 2009 (JP) ..... 2009-243559

(51) Int. Cl.
*B24B 7/16* (2006.01)

(52) U.S. Cl. ..... 451/57; 451/63

(58) Field of Classification Search ..... 451/63, 451/41, 37, 57

See application file for complete search history.

(56) References Cited

U.S. PATENT DOCUMENTS 6,652,358 B1 11/2003 Ikeda et al.
7,150,674 B2 * 12/2006 Okura ..... 451/8
7,347,770 B2 * 3/2008 Ohkura ..... 451/262
7,645,702 B2 1/2010 Koyata et al.
7,662,023 B2 * 2/2010 Vandamme et al. ..... 451/9
7,927,185 B2 * 4/2011 Vandamme et al. ..... 451/9

FOREIGN PATENT DOCUMENTS

JP 2007-096015 4/2007
WO 00/67950 11/2000

* cited by examiner

*Primary Examiner* — Robert Rose

(74) *Attorney, Agent, or Firm* — Greenblum & Bernstein, P.L.C.

(57) ABSTRACT

A double-side grinding apparatus is designed to be capable of minimizing thermal expansion of hydrostatic pad members and reducing nanotopography in performing wafer grinding. The double-side grinding apparatus is a double-side grinding apparatus for wafers that can simultaneously grind either surface of a wafer to be ground by pressing a grindstone against either surface of the wafer to be ground while hydrostatically supporting either surface of the wafer to be ground in a noncontact manner. Each hydrostatic supporting unit is formed with a hydrostatic pad member facing the wafer to be ground, and a base member placed on the back surface of the hydrostatic pad member. The hydrostatic pad member is made of a ceramic member, and the base member is made of a metal member.

13 Claims, 5 Drawing Sheets

PRESENT INVENTION

DOUBLE-SIDE GRINDING APPARATUS FOR WAFER AND DOUBLE-SIDE GRINDING METHOD

BACKGROUND (a) Field of the Invention

The present invention relates to a grinding apparatus and a grinding method for wafers, and more particularly, to a double-side grinding apparatus and a double-side grinding method by which hydrostatic supporting units are placed on either surface side of a semiconductor wafer, and a fluid is supplied to spaces between the wafer and the hydrostatic supporting units, so as to support the wafer physically in a noncontact manner, and simultaneously grind both surfaces of the wafer.

(b) Description of the Related Art

One type of double-side grinding apparatus for semiconductor wafers is an apparatus that hydrostatically supports either surface of a wafer through a fluid, and simultaneously grinds either surface by pressing grindstones against the wafer while rotating the wafer. In this apparatus, hydrostatic supporting units to apply static pressure to the wafer through a fluid are placed at very short distances from the wafer, and the fluid (such as water) is supplied to the very narrow spaces. As a result, the wafer is sandwiched by fluid layers, and is supported without any physical contact with other components. A static supporting unit is normally formed with a static pad member having pockets formed in its wafer facing surface. By supplying a fluid to the pockets, the wafer is hydrostatically supported. Grindstones that are rotating are then pressed against the wafer, and the wafer is also rotated while being held by a holder. In this manner, either surface of the wafer is entirely ground.

In grinding a wafer, unevenness of the wafer surfaces after the grinding often becomes a problem, because trouble such as circuit disconnection is caused at the time of formation of a semiconductor circuit for the wafer. Particularly, surface unevenness called "nanotopography" has components of 0.2 nm to 20 nm in wavelength $\lambda$, and the PV value (Peak to Valley value) of the unevenness is 0.1 μm to 0.2 μm or smaller. In recent years, a technique has been suggested for improving the flatness of a wafer by reducing the nanotopography.

For example, PCT International Publication No. WO/00/67950 discloses a method for reducing nanotopography by adjusting the relative positions of grindstones and a wafer (shift adjustment and tilt adjustment). By such a method, however, nanotopography remains, depending on the shape of the material wafer. To counter this problem, the invention disclosed in Japanese Patent Application Laid-Open (JP-A) No. 2007-96015) has been suggested. By the method disclosed in JP-A No. 2007-96015, pockets are formed in the wafer facing surface of each hydrostatic pad member, and a fluid is supplied to the pockets so that the static pressure at each pocket can be adjusted. Accordingly, the nanotopography of the wafer can be minimized.

In the above described double-side grinding apparatus for wafers, each hydrostatic pad member forming a hydrostatic unit for hydrostatically holding a wafer through a fluid is placed at a very short distance from the wafer, and the fluid is also introduced to the back surface side of the hydrostatic padmember. In this manner, the surface accuracy of the wafer facing surface of each hydrostatic pad member can be adjusted after the hydrostatic pad members are attached, or the heat generated from the wafer facing surface of each hydrostatic pad member during the grinding can be certainly released through the pad members. Therefore, the fluid for applying static pressure is introduced to the back surfaces of the hydrostatic pad members, and the heat conduction to the components in the vicinities of the hydrostatic pad members is blocked as much as possible. FIG. 6-1 schematically shows a conventional hydrostatic pad member supporting structure. As shown in FIG. 6-1, a base member 2 made of stainless steel is placed to face the back surface of a hydrostatic pad member 1, with a void space 3 being interposed therebetween. The base member 2 and the hydrostatic pad member 1 are supported by bolts 4 having spherical washers at several spots. A fluid is also introduced to the void space 3, so as to increase the heat release effect.

However, even if pockets are formed in the wafer facing surface of each hydrostatic pad member so as to adjust the static pressure distribution, the hydrostatic pad members in practice thermally expand due to the heat generated during the grinding. As a result, the wafer facing surface of each hydrostatic pad member is deformed, and the static pressure cannot be distributed evenly onto the entire surface of the wafer. Therefore, a reduction of nanotopography cannot be expected. The cause of this problem is considered as follows. The temperature of each hydrostatic pad member rises due to the heat generated during the grinding. Since the hydrostatic pad members used in the conventional double-side grinding apparatus are made of a metal material such as aluminum or an aluminum alloy, the thermal expansion rate of each of the hydrostatic pad members is high. As a result, the spaces between the wafer and the hydrostatic pad members become uneven due to thermal expansion and contraction or slight deformation of each of the hydrostatic pad members. The unevenness of the spaces is transferred to the wafer through the fluid layers, and causes nanotopography at the time of grinding.

The hydrostatic pad member 1 has a void on its back surface side, and is attached to the metal base member 2 only by the bolts 4 having spherical washers. Therefore, its rigidity is poor, and the attachment positions shift over time. Furthermore, if there is a space between a hydrostatic pad member and a base member as in the conventional example, the fluid heated to a high temperature by the heat generated during the grinding flows into and out of the space, and the temperature of the hydrostatic pad member cannot be lowered. As a result, deformation of the hydrostatic pad member due to thermal expansion cannot be restrained.

SUMMARY

In view of the above problems, the present invention aims to provide a double-side wafer grinding apparatus and method that are designed to be capable of reducing nanotopography in wafer surfaces after grinding by restraining deformation due to thermal expansion of hydrostatic pad members. Secondly, the present invention aims to provide a duplex wafer grinding apparatus and method that are designed to be capable of reducing nanotopography in wafer surfaces after grinding by forming junction structures that are formed with hydrostatic pad members and base members and prevent the temperature of the hydrostatic pad members from becoming too high due to the heat generated during the grinding, eliminating the cause of irregular thermal expansion, and maintaining the flatness of the wafer facing surface of each of the hydrostatic pad members.

In the duplex grinding processing, unevenness is formed in the front and back surfaces of a wafer, unless the front and back surfaces of the wafer are supported in a uniform hydrostatic manner. Taking into consideration the influence of thermal expansion of the supporting units on the unevenness on the front and back surfaces of the wafer, the present invention achieves the above objects by forming hydrostatic pad members made of a ceramic material having a small thermal expansion coefficient, and supporting the back surfaces of the hydrostatic pad members with base members made of a metal material. The above objects can be achieved with the use of a material that is not a ceramic material. However, surfaces with less unevenness can be formed with the use of a ceramic material, and metallic contamination of the wafer can be prevented. A ceramic material is also preferred, because its abrasion resistance against wafer contact is high.

To achieve the above objects, a double-side grinding apparatus for wafers according to the present invention includes a hydrostatic supporting unit that supports a wafer to be ground by supplying a fluid to both surfaces of the wafer to be ground, and a grindstone that is pressed against both surfaces of the wafer to be ground, and rotates to grind the wafer to be ground. The hydrostatic supporting unit is formed with a hydrostatic pad member that faces the wafer to be ground, and a base member that is placed on the back surface of the hydrostatic pad member and is subject to reactive force. The hydrostatic pad member is made of a ceramic material, and the base member is made of a metal material.

In this case, it is preferable that the back surface of the hydrostatic pad member and the base member are integrally fastened together by a fastening member in a face-bonded state. Also, to achieve target wafer flatness, the flatness of the wafer facing surface of the hydrostatic pad member and/or the flatness of the back surface of the hydrostatic pad member bonded to the base member and/or the flatness of the bonded surface of the base member bonded to the hydrostatic pad member are preferably set at a predetermined value or smaller. Here, the predetermined value is preferably 10 μm. The thermal expansion rate of the hydrostatic pad member is preferably 10 μm/° C. or lower when the ambient temperature of the hydrostatic pad member is 23° C. Further, pockets to which the fluid is supplied are formed in the wafer facing surface of the hydrostatic pad member. The ceramic material is preferably alumina, zirconia, silicon nitride, or silicon carbide.

A double-side grinding method for wafers according to the present invention includes placing a hydrostatic pad member made of a ceramic material on either surface of a wafer to be ground, hydrostatically supporting either surface of the wafer to be ground in a noncontact state by supplying a fluid to a space between the hydrostatic pad member and the wafer to be ground, while the back surface of the hydrostatic pad member is face-bonded to a base member made of a metal material, pressing a grindstone against either surface of the hydrostatically supported wafer to be ground, and causing the grindstone to rotate itself and circle in the circumferential direction of the wafer to be ground in orbital motion, while rotating the wafer to be ground, thereby simultaneously grinding the two surfaces of the wafer to be ground.

In this case, to achieve target wafer flatness, the flatness of the wafer facing surface of the hydrostatic pad member and/or the flatness of the back surface of the hydrostatic pad member bonded to the base member and/or the flatness of the bonded surface of the base member bonded to the hydrostatic pad member are preferably set at a predetermined value or smaller. Here, the predetermined value is preferably 10 μm. The thermal expansion rate of the hydrostatic pad member is preferably 10 μm/° C. or lower when the ambient temperature of the hydrostatic pad member is 23° C. Further, pockets to which the fluid is supplied are formed in the wafer facing surface of the hydrostatic pad member. The ceramic material is preferably alumina, zirconia, silicon nitride, or silicon carbide.

As described above, the hydrostatic pad members facing a wafer are made of a ceramic material, so that deformation of the hydrostatic pad members due to thermal expansion can be restrained. In other words, even if the temperature of the hydrostatic pad members rises due to the heat generated during the grinding, deformation of the hydrostatic pad members through thermal expansion can be restrained. As a result, the nanotopography in the wafer surfaces after the grinding can be reduced. Also, even if the temperature of the hydrostatic pad members rises due to the heat generated during the grinding, a temperature rise in the hydrostatic pad members can be restrained, because the heat is conducted from the hydrostatic pad members to the base members face-bonded to the back surfaces of the hydrostatic pad members. Accordingly, deformation of the hydrostatic pad members through thermal expansion can be further restrained. As a result, the nanotopography in the wafer surfaces after the grinding can be reduced. Also, to achieve target wafer flatness, the flatness of the wafer facing surface of each hydrostatic pad member and/or the flatness of the back surfaces of each hydrostatic pad member bonded to the base member and/or the flatness of the bonded surface of each base member bonded to the hydrostatic pad member are set at a predetermined value or smaller. The hydrostatic pad members are then face-bonded to the base members. Further, a ceramic material having a low thermal expansion rate is used for the hydrostatic pad members, so as to eliminate the cause of irregular thermal expansion in the junction structures that are formed with the hydrostatic pad members and the base members and prevent a temperature rise of the hydrostatic pad members due to the heat generated during the grinding. By doing so, the flatness of the wafer facing surface of each hydrostatic pad member can be maintained, and the nanotopography in the wafer surfaces after the grinding can be reduced. Since ceramic materials are more resistant to deformation and abrasion than regular metal materials and resin materials, a ceramic material is useful for maintaining normal operation of the apparatus.

BRIEF DESCRIPTION OF THE DRAWINGS

FIG. 6-1 is a schematic view of a conventional hydrostatic pad member supporting structure; and FIG. 6-2 is a schematic view of a hydrostatic pad member supporting structure of the present invention.

DETAILED DESCRIPTION OF EMBODIMENTS

The following is a description of an embodiment of a double-side grinding apparatus for wafers according to the present invention, with reference to the accompanying drawings. The following embodiment is merely an example of the present invention, and various other structures may be used within the technical scope of the invention.

Figure 1:
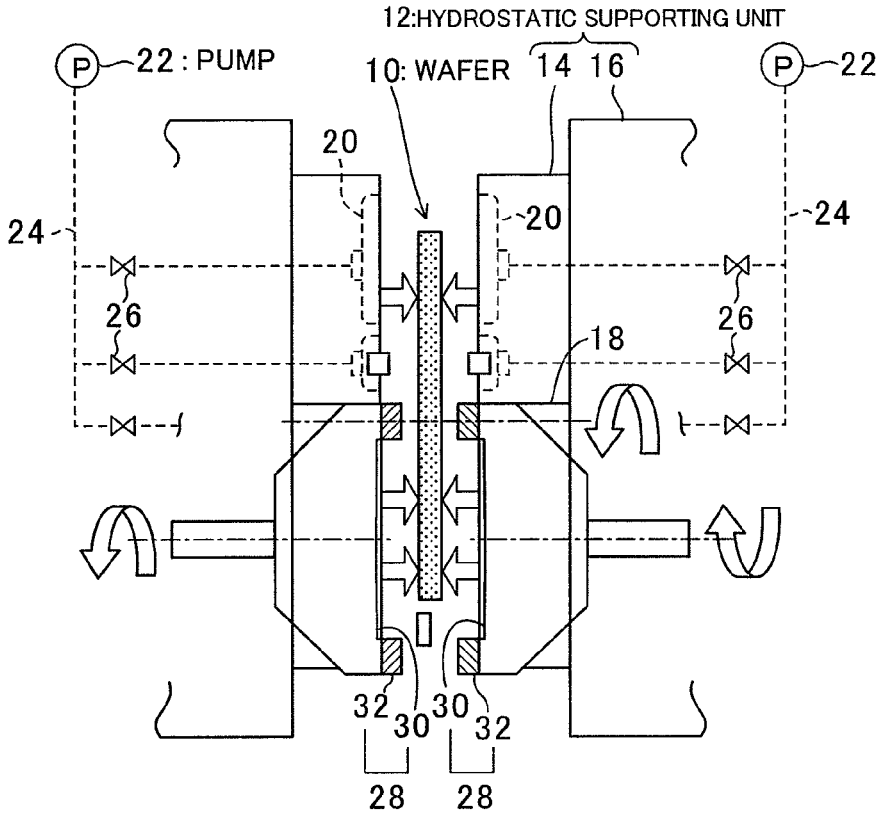
FIG. 1 is a schematic cross-sectional view of the hydrostatic supporting unit part of a double-side grinding apparatus according to an embodiment of the present invention.
Figure 2:
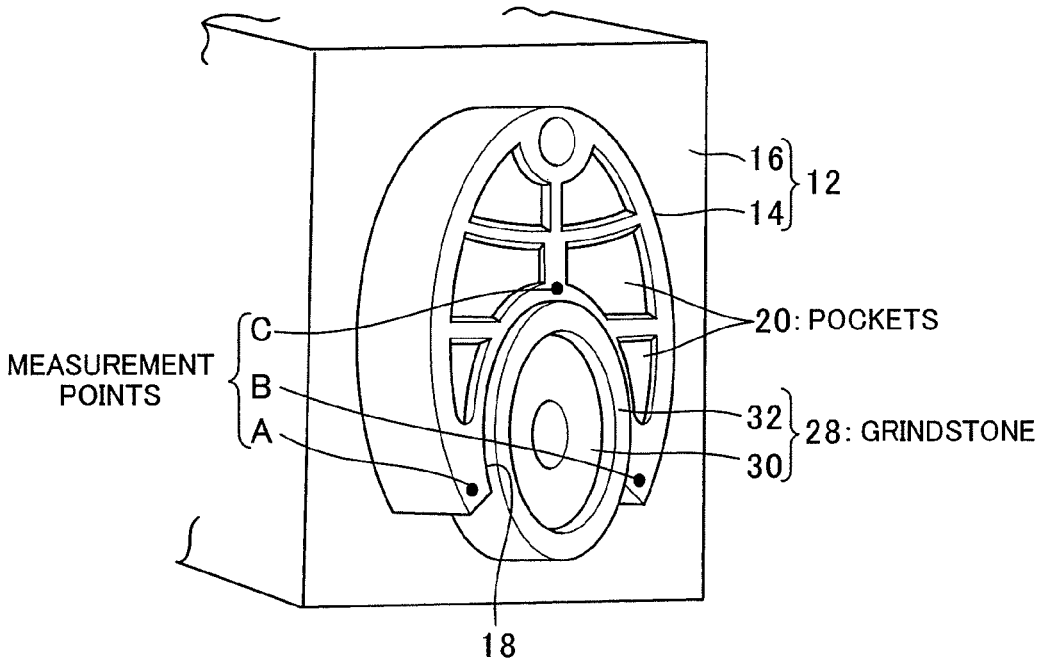
FIG. 2 is a perspective view of the left-side hydrostatic supporting unit shown in FIG. 1.

FIG. 1 is a cross-sectional view schematically showing the components of the hydrostatic supporting unit and the components surrounding the hydrostatic supporting unit in a double-side grinding apparatus for wafers according to the embodiment. FIG. 2 is a perspective view of the hydrostatic supporting unit shown in the upper left part of FIG. 1. As shown in FIG. 1, the double-side grinding apparatus of this embodiment has a wafer 10 to be ground at its center portion, and a pair of hydrostatic supporting units 12 at both side portions. Each of the hydrostatic supporting units 12 is formed with a hydrostatic pad member 14 directly facing the wafer 10, and a metal base member 16 placed on the back surface of the hydrostatic pad member 14.

The hydrostatic pad member 14 is a disk having a diameter slightly larger than the wafer 10 to be ground. A round opening portion 18 is formed near part of the outer peripheral side of the hydrostatic padmember 14, so that the hydrostatic padmember 14 has a crescent shape as a whole when seen in a front view. Pockets 20 formed with concavities are provided on the surface of the hydrostatic pad member 14 or the surface facing the wafer 10 to be ground. A fluid is supplied to the pockets 20 from a pump 22 through piping 24. By injecting the fluid on both sides of the wafer 10, a fluid layer is formed between the hydrostatic pad member 14 and the wafer 10, and the wafer 10 can be hydrostatically held. The supported state of the wafer 10 can also be adjusted by controlling the discharge pressure onto the respective pockets 20 by valves 26 independently of one another.

A grindstone 28 having a diameter that fits the round opening portion 18 is housed in the round opening portion 18 formed in the hydrostatic pad member 14. The grindstone 28 is formed as a cup-type grindstone, and has a grindstone ring 32 attached to the periphery of a round disk portion 30 having a diameter that is almost equal to the radius of the hydrostatic pad member 14. The cup-type grindstone 28 is designed to be able to rotate inside the round opening portion 18 by virtue of a drive unit (not shown) provided on the side of the metal base member 16. The grindstone ring 32 is pressed against the wafer 10 and is rotated, while protruding from the surface of the hydrostatic pad member 14. In this manner, a polishing operation is performed.

Meanwhile, the wafer 10 is held by a ring support (not shown) supporting the wafer outer periphery, and is transferred to a position between the pair of hydrostatic supporting units 12 by the ring support. The wafer 10 is then rotated by an appropriate mechanism.

As described above, this double-side grinding apparatus rotates the cup-type grindstones 28 on both sides of the wafer 10, and brings the cup-type grindstones 28 into contact with the wafer 10 at a position deviated away from its center. At the same time, the double-side grinding apparatus rotates the wafer 10. Each cup-type grindstone 28 makes an orbital motion by circling on each corresponding wafer surface in the circumferential direction. At the same time, each cup-type grindstone rotates, and the wafer 10 rotates. In this manner, the entire surfaces of the wafer 10 can be ground.

In such a double-side grinding apparatus, the hydrostatic pad members 14 are made of a ceramic material, and the metal base members 16 are made of stainless steel. It is of course possible to use a metal material other than stainless steel. In this embodiment, a ceramic material having a lower thermal expansion rate than aluminum-based materials is used for the hydrostatic pad members 14 facing the wafer 10, and the metal base members 16 formed with blocks made of stainless steel to back up reactive force are placed on the back surfaces of the hydrostatic pad members 14. Since the hydrostatic pad members 14 are face-bonded and attached directly to the metal base members 16 with high rigidity, the attachment rigidity becomes higher, and the stability in grinding operation improves. Particularly, a ceramic material having a thermal expansion rate of 10 μm/° C. or lower when the ambient temperature of the hydrostatic pad members 14 is 23° C. is used for the ceramic hydrostatic pad members 14. It is preferable to use a ceramic material such as alumina, zirconia, silicon nitride, or silicon carbide.

Figure 3:
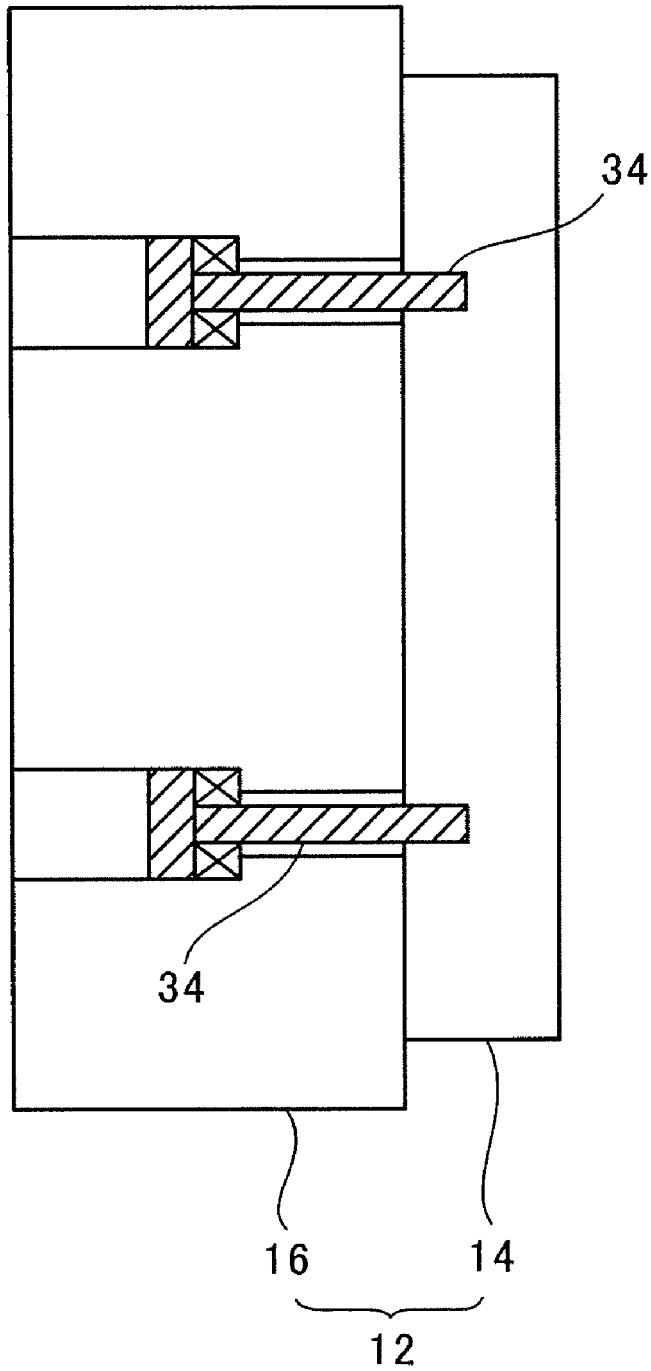
FIG. 3 is a cross-sectional view for explaining the face bonding between a metal base member and a hydrostatic pad member.

Even where the hydrostatic pad members 14 made of a ceramic material are used, the supplied fluid is heated by the heat generated during grinding, if there is a space on the back surface side of a hydrostatic pad member 14. The heated fluid flows to the wafer facing side of the hydrostatic pad member 14, and also flows to the back side. As a result, the hydrostatic pad member 14 is heated to a high temperature, and is deformed due to thermal expansion. If each hydrostatic pad member 14 is an independent body, each hydrostatic pad member 14 is heated to a high temperature by the heat generated during grinding, and is deformed due to thermal expansion. To counter this problem in this embodiment, the metal base members 16 placed on the back surfaces of the hydrostatic pad members 14 are face-bonded to the hydrostatic pad members 14, and the metal base members 16 and the hydrostatic pad members 14 are integrally fastened together by fastening members 34 such as bolts, as shown in FIG. 3. Here, the thermal expansion rate of each hydrostatic pad member 14 facing the wafer 10 is adjusted to 10 μm/° C. or lower, and the surface roughness in the wafer facing surface of each hydrostatic pad member 14 and/or each bonded surface between the hydrostatic pad members 14 and the metal base members 16 is adjusted so that the flatness of the wafer facing surface of each hydrostatic pad member 14 and/or the flatness of the back surface of each hydrostatic pad member 14 joined to the corresponding metal base member 16 and/or the flatness of the joined surface of each metal base member 16 joined to the corresponding hydrostatic pad member 14 become 10 μm or smaller. More specifically, where the surface unevenness of the wafer 10 after the grinding is restricted to a target value of 10 μm or smaller, the thermal expansion rate of each hydrostatic pad member 14 facing the wafer 10 is adjusted to 10 μm/° C. or lower, and the flatness of the wafer facing surface of each hydrostatic pad member 14 and/or the flatness of the back surface of each hydrostatic pad member 14 joined to the corresponding metal base member 16 and/or the flatness of the joined surface of each metal base member 16 joined to the corresponding hydrostatic pad member 14 are adjusted to 10 μm or smaller. Where the surface unevenness of the wafer 10 after the grinding is restricted to a target value of 5 μm or smaller, the thermal expansion rate of each hydrostatic pad member 14 facing the wafer 10 is adjusted to 5 μm/° C. or lower, and the flatness of the wafer facing surface of each hydrostatic pad member 14 and/or the flatness of the back surface of each hydrostatic pad member 14 joined to the corresponding metal base member 16 and/or the flatness of the joined surface of each metal base member 16 joined to the corresponding hydrostatic pad member 14 are also adjusted to 5 μm or smaller. As a result, even if the roughness of the joined surface between each metal base member 16 and each hydrostatic pad member 14 is transferred onto the wafer facing surface of the hydrostatic pad member 14, or even if the hydrostatic pad members 14 thermally expand due to the heat generation caused during the processing, the space between the wafer 10 and the surface of each hydrostatic pad member 14 facing the wafer 10 can be maintained as small as 10 μm or smaller, or 5 μm or smaller. Accordingly, duplex grinding is performed with higher precision, to achieve target processing accuracy. Also, because of the face bonding, the heat from the hydrostatic pad members 14 is absorbed by the metal base members 16 through heat conduction, and the hydrostatic pad members 14 achieve a temperature rise prevention effect by virtue of this face-bonding structure.

The double-side grinding apparatus having the above structure can reduce nanotopography in wafer grinding by minimizing the thermal expansion rate of the hydrostatic pad members 14. Also, the flatness of the wafer facing surface of each hydrostatic pad member 14 and/or the flatness of the back surface of each hydrostatic pad member 14 joined to the corresponding metal base member 16 and/or the flatness of the joined surface of each metal base member 16 joined to the corresponding hydrostatic padmember 14 is set at a predetermined value or smaller, and face bonding is then performed. A ceramic material having a thermal expansion rate that achieves the target flatness or smaller is used for the hydrostatic pad members 14, so that the hydrostatic pad members 14 and the metal base members 16 form junction structures in which the hydrostatic pad members 14 are not heated to a high temperature by the heat generated during the grinding. In this manner, the cause of uneven thermal expansion is eliminated, and the flatness of the wafer facing surface of each pad member can be maintained. Thus, nanotopography can be reduced.

By a grinding method using the above described double-side grinding apparatus, hydrostatic pad members made of a ceramic material are provided to face both surfaces of a wafer to be ground. With the back surfaces of the hydrostatic pad members being face-bonded to base members made of a metal material, a fluid is introduced to spaces between the hydrostatic pad members and the wafer to be ground, so that both surfaces of the wafer to be ground are hydrostatically supported in a noncontact manner. A grindstone is pressed against both surfaces of the hydrostatically-supported wafer to be ground, and the grindstone rotates itself and also circles in the circumferential direction of the wafer to be ground in orbital motion, while the wafer to be ground rotates. In this manner, both surfaces of the wafer are ground at the same time.

Figure 4:
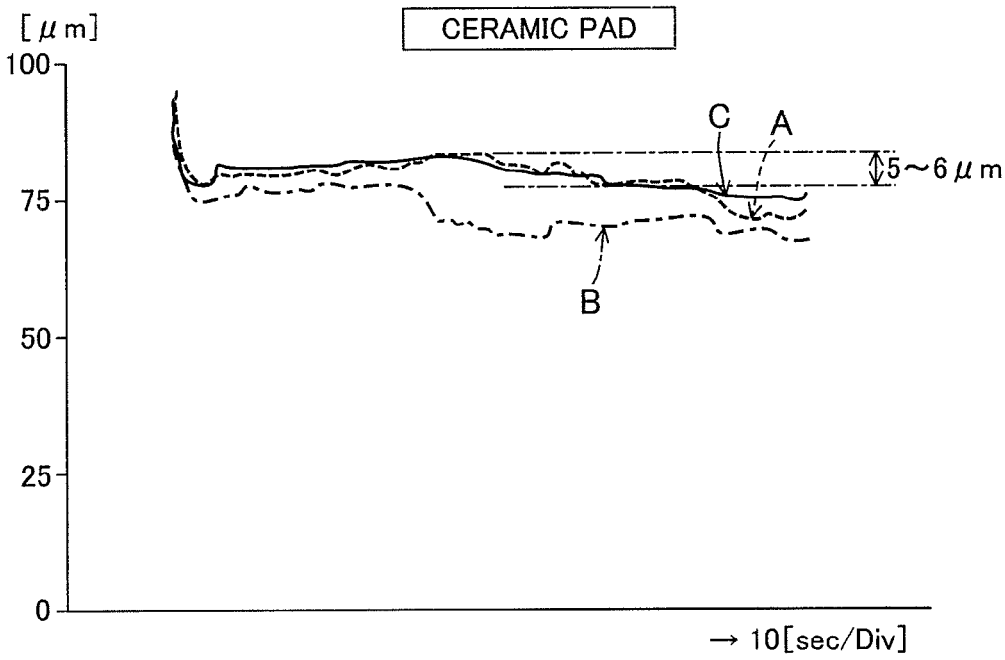
FIG. 4 shows the results of an examination carried out to check the thermal fluctuation of a hydrostatic pad member made of a ceramic material during the grinding process.
Figure 5:
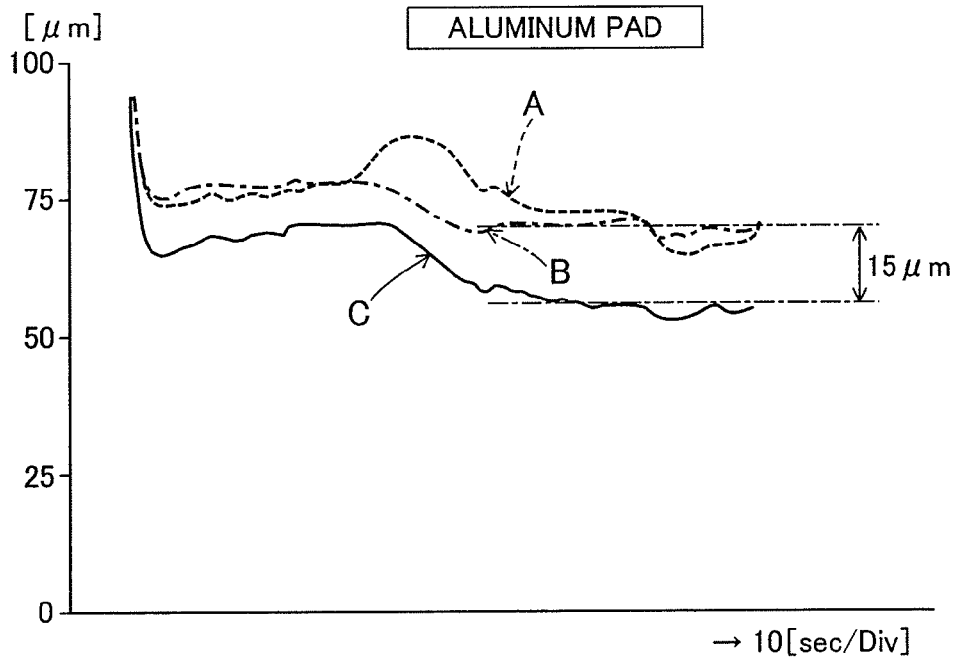
FIG. 5 shows the results of an examination carried out to check the thermal fluctuation of a hydrostatic pad member made of an aluminum member as a comparative example.
Figures 1, 6:
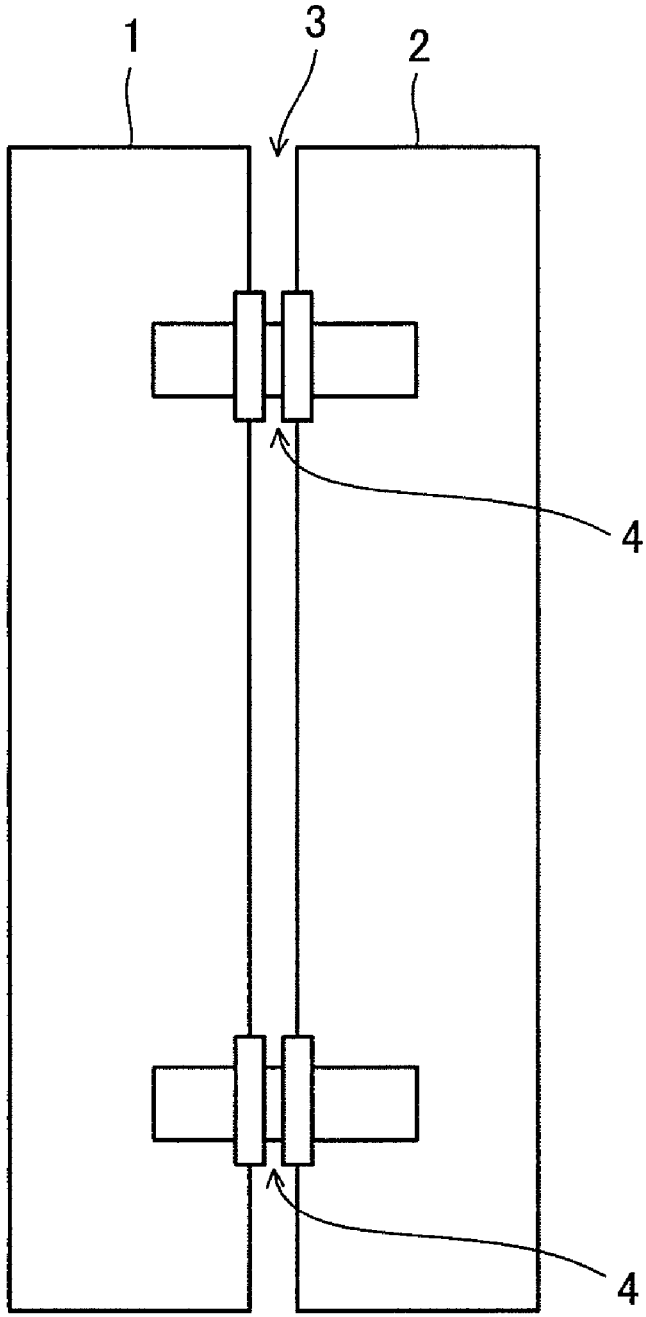
Fig.6-1 PRIOR ART
Figures 2, 6:
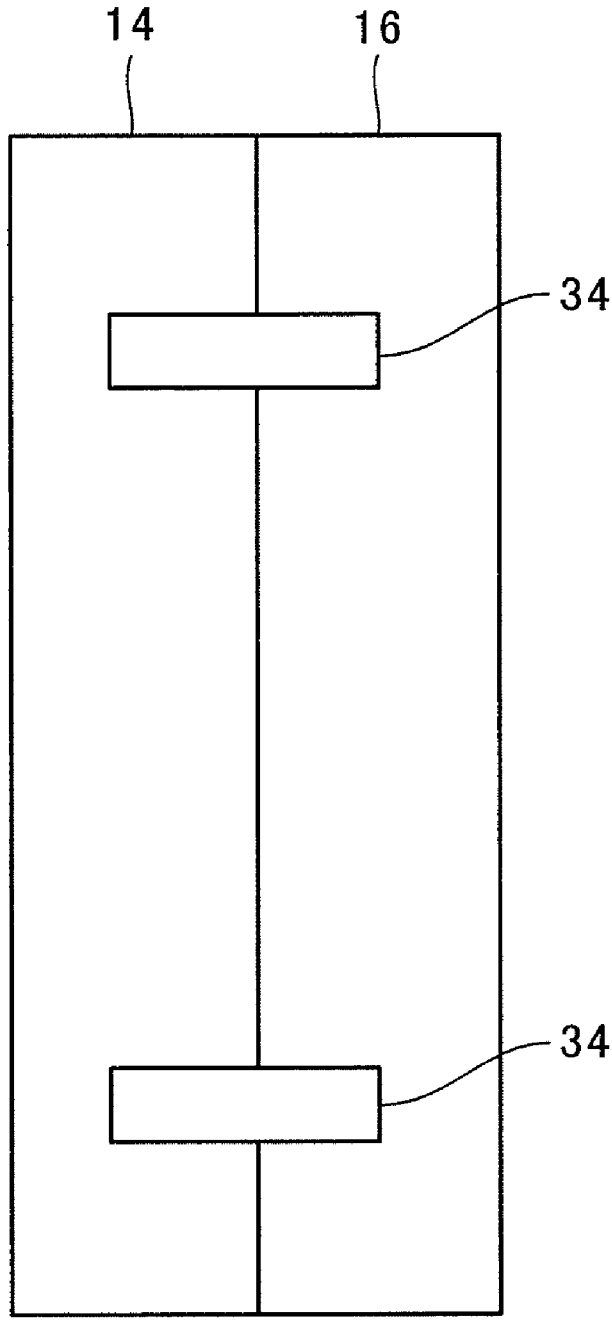

FIG. 4 shows the results of an examination carried out to check the thermal fluctuation of a hydrostatic pad member 14 during the grinding process performed in the double-side grinding apparatus using the hydrostatic pad member 14 made of a ceramic material in accordance with this embodiment. FIG. 5 shows the results of an examination carried out to check the thermal fluctuation of a hydrostatic pad member as a comparative example made of an aluminum material. The measurement points are the front lower point A, the rear lower point B, and the center point C shown in FIG. 2. One division of the abscissa axis indicating time is 10 seconds.

As can be seen from the results, in the case of the hydrostatic pad member of the comparative example made of an aluminummaterial, a thermal expansion of 14 μm into 15 μm is observed at the center of the hydrostatic pad member, and an expansion of 14 μm to 15 μm is also observed at the rear lower portion of the hydrostatic pad member. Here, the largest expansions are observed. Since those portions are the first to receive the fluid (water) heated by the heat generated during the grinding, those portions greatly expand and quickly contract when the load for grinding the wafer is large. An expansion of approximately 9 μm is observed at the front lower portion of the hydrostatic pad member. In the case of the hydrostatic pad member made of a ceramic material in accordance with this embodiment, on the other hand, a thermal expansion of 5 μm to 6 μm is observed at the center point C of the hydrostatic pad member, and an expansion of 5 μm to 6 μm is also observed at the rear lower portion B of the hydrostatic pad member. Here, the largest expansions caused when the load for grinding is highest are not observed. An expansion of approximately 9 μm is observed at the front lower portion A of the hydrostatic pad member. As can be seen from those results, the expansion of the hydrostatic pad member made of a ceramic material is very small, being 10 μm or smaller, and the nanotopography caused by a grinding apparatus is eliminated.

The value of the nanotopography in the wafer surfaces after grinding is the PV value (Peak to Valley value) in a 10 mm×10 mm area. Where hydrostatic pad members made of a ceramic material are used, the nanotopography value is 14 nm. Where hydrostatic pad members made of an aluminum material, the nanotopography value is 20 nm. As is apparent from those values, the nanotopography in the wafer surfaces after grinding can be reduced by this embodiment of the present invention.

As described above, in the structure according to this embodiment, the hydrostatic pad members 14 of the hydrostatic supporting units 12 facing the wafer 10 are made of a ceramic material, and the base members 16 made of a metal material are bonded to the back surfaces of the hydrostatic pad members 14. With this structure, adverse influence of thermal expansion of the hydrostatic pad members 14 can be avoided, and the wafer facing surfaces of the hydrostatic padmembers 14 can be smoothed. Accordingly, the fluid layers for applying static pressure can also be smoothed. Thus, the nanotopography in the wafer surfaces after grinding can be made smaller.

Although each of the hydrostatic pad members 14 has a flat crescent shape in the above described embodiment, the shapes of the hydrostatic pad members 14 can be arbitrarily set.

In accordance with the above described embodiment, the unevenness of the wafer surfaces can be minimized, and higher or more stable quality can be achieved. Furthermore, ceramic materials have less degradation due to deformation and abrasion than metal materials and resin materials, and accordingly, the high quality of the wafer can be maintained after the grinding.

The invention claimed is:

1. A double-side grinding apparatus for wafers, comprising:

a hydrostatic supporting unit that supports a wafer to be ground by supplying a fluid to both surfaces of the wafer to be ground in a noncontact state; and a grindstone that is pressed against both surfaces of the wafer to be ground, and rotates to grind the wafer to be ground, the hydrostatic supporting unit being formed with a hydrostatic pad member that faces the wafer to be ground, and a base member that is placed on a back surface of the hydrostatic pad member and receives reactive force, the hydrostatic pad member being made of a ceramic material, the base member being made of a metal material.

2. The double-side grinding apparatus for wafers according to claim 1, wherein a back surface of the hydrostatic pad member and the base member are integrally fastened together by a fastening member in a face-bonded state.

3. The double-side grinding apparatus for wafers according to claim 2, wherein, to achieve target wafer flatness, flatness of a wafer facing surface of the hydrostatic pad member and/or flatness of the back surface of the hydrostatic pad member bonded to the base member and/or flatness of a bonded surface of the base member bonded to the hydrostatic pad member are set at a predetermined value or smaller.

4. The double-side grinding apparatus for wafers according to claim 3, wherein the predetermined value is 10 μm.

5. The double-side grinding apparatus for wafers according to claim 1, wherein a thermal expansion rate of the hydrostatic pad member is 10 μm/° C. or lower, when an ambient temperature of the hydrostatic pad member is 23° C.

6. The double-side grinding apparatus for wafers according to claim 1, wherein a plurality of pockets to which the fluid is supplied are formed in the wafer facing surface of the hydrostatic pad member.

7. The double-side grinding apparatus for wafers according to claim 1, wherein the ceramic material is alumina, zirconia, silicon nitride, or silicon carbide.

8. A double-side grinding method for wafers, comprising:

placing a hydrostatic pad member made of a ceramic material on either surface of a wafer to be ground;

hydrostatically supporting either surface of the wafer to be ground in a noncontact state by supplying a fluid to a space between the hydrostatic pad member and the wafer to be ground, while a back surface of the hydrostatic pad member is face-bonded to a base member made of a metal material;

pressing a grindstone against either surface of the hydrostatically supported wafer to be ground;

causing the grindstone to rotate itself and circle in a circumferential direction of the wafer to be ground in orbital motion, while rotating the wafer to be ground, thereby simultaneously grinding either surface of the wafer to be ground.

9. The double-side grinding method for wafers according to claim 8, wherein, to achieve target wafer flatness, flatness of a wafer facing surface of the hydrostatic pad member and/or flatness of the back surface of the hydrostatic pad member bonded to the base member and/or flatness of a bonded surface of the base member bonded to the hydrostatic pad member are set at a predetermined value or smaller.

10. The double-side grinding method for wafers according to claim 9, wherein the predetermined value is 10 μm.

11. The double-side grinding method for wafers according to claim 8, wherein a thermal expansion rate of the hydrostatic pad member is 10 μm/° C. or lower, when an ambient temperature of the hydrostatic pad member is 23° C.

12. The double-side grinding method for wafers according to claim 8, wherein a plurality of pockets to which the fluid is supplied are formed in the wafer facing surface of the hydrostatic pad member.

13. The double-side grinding method for wafers according to claim 8, wherein the ceramic material is alumina, zirconia, silicon nitride, or silicon carbide.

* * * * *